US005951899A

United States Patent [19]

Eichler et al.

[11] Patent Number: 5,951,899

[45] Date of Patent: Sep. 14, 1999

[54] BURNER ASSEMBLY HAVING A SHIELDED PORCELAIN BURNER BOWL

[75] Inventors: Roger Eichler, Plano, Tex.; George May, Florence, S.C.

[73] Assignee: Amana Company, L.P., Houston, Tex.

[21] Appl. No.: 08/864,532

[22] Filed: May 28, 1997

[51] Int. Cl.[6] ..... H05B 3/68; F24C 3/04

[52] U.S. Cl. ..... 219/451.1; 126/92 B

[58] Field of Search ..... 219/448, 449, 219/451, 452, 453, 458, 460, 461, 463, 464; 126/393, 90 A, 92 AC, 92 A, 92 B

[56] References Cited

U.S. PATENT DOCUMENTS

| | | | |
|---|---|---|---|
| 1,375,801 | 4/1921 | Ross | 219/393 |
| 3,624,352 | 11/1971 | Deaton | 219/449 |
| 3,696,232 | 10/1972 | Salinger | 219/463 |
| 3,783,239 | 1/1974 | Hill et al. | 219/461 |
| 3,870,862 | 3/1975 | Doner | 219/464 |
| 3,971,361 | 7/1976 | Hurko | 126/390 |
| 4,009,795 | 3/1977 | Hurko et al. | 219/461 |
| 4,598,691 | 7/1986 | Herrelko et al. | 126/41 R |
| 5,079,408 | 1/1992 | Jordan, Jr. | 219/461 |
| 5,643,481 | 7/1997 | Brotzki et al. | 219/461 |

*Primary Examiner*—Teresa Walberg
*Assistant Examiner*—Sam Paik
*Attorney, Agent, or Firm*—Tobor, Goldstein & Healey, L.L.P.

[57] ABSTRACT

A cooktop has a burner box. A porcelain wall is arranged to be removably fitted to the burner box so as form a burner box housing. The wall has a plurality of holes. Each porcelain bowl receives a corresponding heating element and has a basin which protrudes through a corresponding hole. A bowl shield is provided for each of the porcelains bowls such that each of the bowl shields is formed substantially around a corresponding basin. A plurality of controls control the heating elements. A temperature limit control deactivates at least one of the controls in the event of an over temperature condition.

36 Claims, 5 Drawing Sheets

BURNER ASSEMBLY HAVING A SHIELDED PORCELAIN BURNER BOWL

TECHNICAL FIELD OF THE INVENTION

The present invention relates to a burner assembly, such as may be used on a stove or a cooktop, having a shielded porcelain bowl.

BACKGROUND OF THE INVENTION

Electric cooking appliances, such as electric cooktops and stoves, typically employ high wattage resistance coil heating elements which are energized to heat the contents of various cooking vessels. These high wattage resistance coil heating elements usually are provided in two sizes (for example, eight inch elements and six inch elements) and two wattages (for example, 2600 watts for the eight inch elements and 1500 watts for six inch elements). Also, these high wattage resistance coil heating elements typically have been used with burner bowls (which are sometimes referred to as drip pans) that are arranged to collect drips, spills, boil-overs, and/or the like. Thus, such drips, spills, boil-overs, and/or the like do not reach appliance parts, such as cooktop burner boxes, that are beneath the high wattage resistance coil heating elements.

Burner bowls in the past have been primarily chrome burner bowls. Chrome burner bowls reflect heat fairly efficiently. Accordingly, chrome burner bowls stay relatively cool because they do not absorb any appreciable amount of heat. However, chrome burner bowls cannot be provided in colors that match the other surfaces of the cooking appliance or the cooking area in which the cooking appliance is used.

Furthermore, the application of ever-increasing wattages for the high wattage heating elements used in cooking appliances requires that the heat density generated by these high wattage heating elements be shielded from the normally combustible cabinets which either house the cooking appliance or which are adjacent thereto.

The present invention is directed to burner assemblies which have color matching burner bowls and adequate heat shielding.

SUMMARY OF THE INVENTION

In accordance with one aspect of the present invention, a burner assembly for a cooking appliance comprises a heating element, a porcelain bowl, and a bowl shield. The porcelain bowl is arranged to receive the heating element. The bowl shield is substantially around the porcelain bowl.

In accordance with another aspect of the present invention, a cooktop comprises a wall, first and second heating elements, first and second porcelain bowls, first and second bowl shields, and first and second controllers. The wall has first and second holes. The first porcelain bowl has a basin and a lip. The basin of the first porcelain bowl protrudes through the first hole and is arranged to receive the first heating element. The lip of the first porcelain bowl rests on the wall. The second porcelain bowl has a basin and a lip. The basin of the second porcelain bowl protrudes through the second hole and is arranged to receive the second heating element. The lip of the second porcelain bowl rests on the wall. The first bowl shield is substantially around the basin of the first porcelain bowl, and the second bowl shield is substantially around the basin of the second porcelain bowl. The first controller controls the first heating element, and the second controller controls the second heating element.

In accordance with yet another aspect of the present invention, a cooktop comprises a burner box, a wall, a plurality of heating elements, a plurality of porcelain bowls, a plurality of bowl shields, a plurality of controls, and a control box. The wall is arranged to be removably fitted to the burner box so as to form a burner box housing, and the wall has a plurality of holes therethrough. Each of the porcelain bowls has a corresponding basin, each of the porcelain bowls is arranged to receive a corresponding heating element, and the basin of each of the porcelain bowls protrudes through a corresponding hole into the burner box housing. Each of the bowl shields is fashioned substantially around the basin of a corresponding porcelain bowl. Each of the controls is provided for a corresponding heating element and protrudes through the wall into the burner box housing. The control box is in the burner box housing, and the control box is fashioned substantially around a portion of the controls protruding through the wall.

BRIEF DESCRIPTION OF THE DRAWINGS

These and other features and advantages of the present invention will become more apparent from a detailed consideration of the invention when taken in conjunction with the drawings in which.

DETAILED DESCRIPTION

Figure 1:
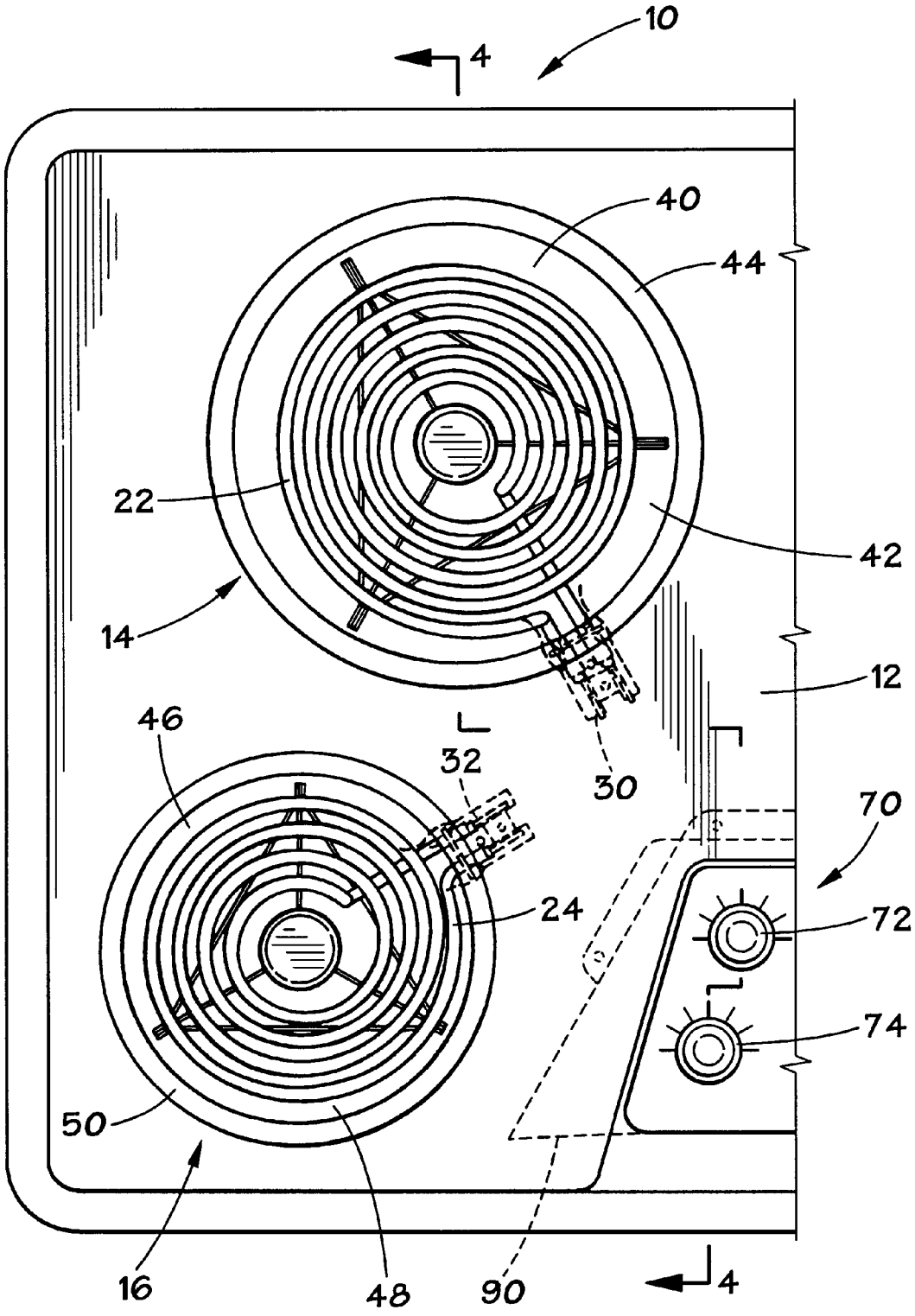
FIG. 1 is a partial top-view of one embodiment of the cook-top.
Figure 2:
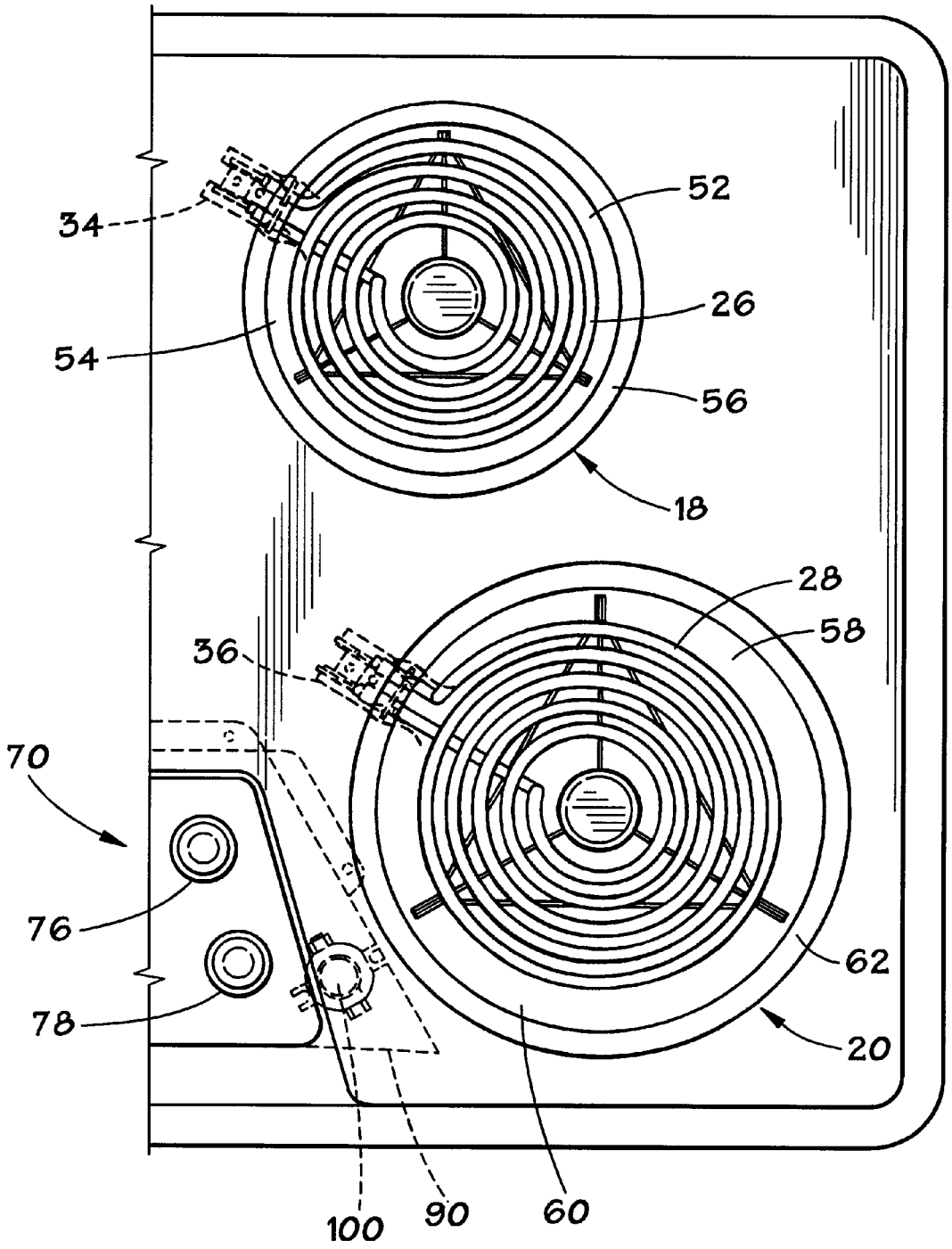
FIG. 2 is a partial top-view of one embodiment of the cook-top.
Figure 3:
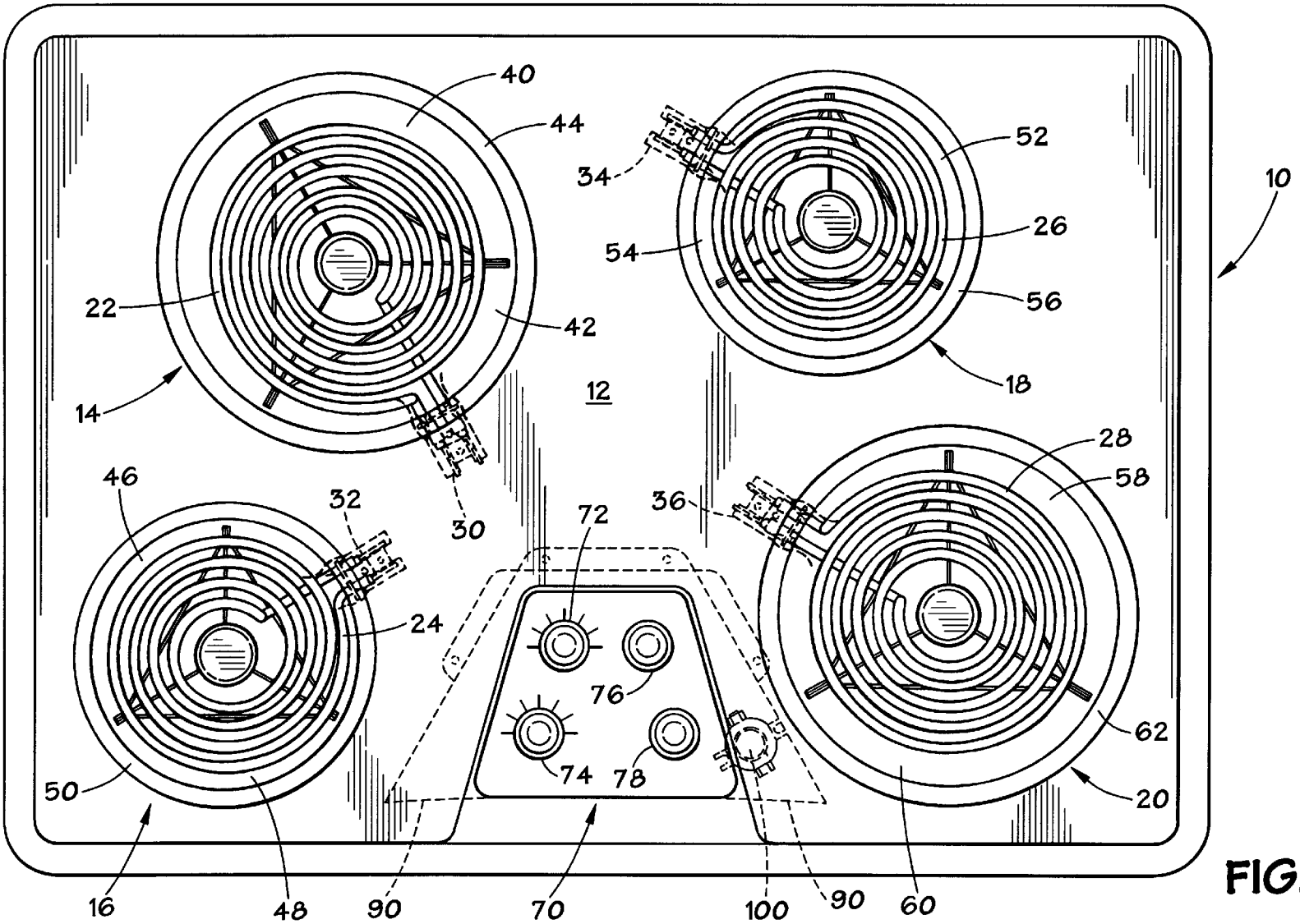
FIG. 3 is a top-view of the cook-top illustrating the combination of the partial top-views of the embodiment shown in FIG. 1 and FIG. 2.

The present invention is disclosed particularly in connection with a cooktop 10, which is illustrated in FIGS. 1, 2, 3, and 4. However, it should be understood that the present invention is useful in connection with other types of cooking appliances such a stoves, ranges, and the like.

The cooktop 10 includes a wall 12 which supports four burner assemblies 14, 16, 18, and 20. The burner assemblies 16 and 18 may be smaller in diameter than the burner assemblies 14 and 20. The burner assembly 14 has a heating element 22, the burner assembly 16 has a heating element 24, the burner assembly 18 has a heating element 26, and the burner assembly 20 has a heating element 28. For example, each of the heating elements 22 and 28 may be an eight inch, 2600 watt electric resistance coil, and each of the heating elements 24 and 26 may be a six inch 1500 watt electric resistance coil. However, it should be understood that the heating elements 22, 24, 26, and 28 may be of any size and wattage, including the same size and wattage or all different sizes and wattages.

The heating element 22 has an electrical connector 30 which provides an electrical connection at each end of a coil that forms the heating element 22. The electrical connector 30 allows the heating element 22 to mate with an electrical connector (not shown) secured to the wall 12 of the cooktop 10. Similarly, the heating element 24 has an electrical connector 32, the heating element 26 has an electrical connector 34, and the heating element 28 has an electrical connector 36, each of which mates with a corresponding electrical connector (not shown) secured to the wall 12 of the cooktop 10.

The burner assembly 14 has a burner bowl 40 which serves to catch drips and the like from the cooking vessels being heated by the heating element 22. The burner bowl 40 has a basin 42, which fits through a corresponding hole in the wall 12 of the cooktop 10, and a lip 44, which rests against the wall 12 of the cooktop 10 in order to suspend the basin 42 of the burner bowl 40 from the wall 12.

The burner assembly 16 has a burner bowl 46 which serves to catch drips and the like from the cooking vessels being heated by the heating element 24. The burner bowl 46 has a basin 48, which fits through a corresponding hole in the wall 12 of the cooktop 10, and a lip 50, which rests against the wall 12 of the cooktop 10 in order to suspend the basin 48 of the burner bowl 46 from the wall 12.

The burner assembly 18 has a burner bowl 52 which serves to catch drips and the like from the cooking vessels being heated by the heating element 26. The burner bowl 52 has a basin 54, which fits through a corresponding hole in the wall 12 of the cooktop 10, and a lip 56, which rests against the wall 12 of the cooktop 10 in order to suspend the basin 54 of the burner bowl 52 from the wall 12.

The burner assembly 18 has a burner bowl 58 which serves to catch drips and the like from the cooking vessels being heated by the heating element 23. The burner bowl 58 has a basin 60, which fits through a corresponding hole in the wall 12 of the cooktop 10, and a lip 62, which rests against the wall 12 of the cooktop 10 in order to suspend the basin 60 of the burner bowl 58 from the wall 12.

The wall 12 of the cooktop 10 and the burner bowls 40, 46, 52 and 58 may each be metal, such as stainless steel, covered by a porcelain enamel. Alternatively, each of the burner bowls 40, 46, 52 and 58 may be comprise any other metal covered by a porcelain enamel, or they may solid porcelain. Because of the porcelain, the burner bowls 40, 46, 52, and 58 and the wall 12 may be color-coordinated with each other and with a color scheme of the kitchen or other cooking area in which the cooktop 10 is used. Accordingly, the appearance of the cooktop 10 is enhanced.

The cooktop 10 has a control area 70. The control area 70 includes four temperature controllers 72, 74, 76, and 78. The temperature controller 72 may be electrically connected through the electrical connector 30 in order to control the heating element 22, the temperature controller 74 may be electrically connected through the electrical connector 32 in order to control the heating element 24, the temperature controller 76 may be electrically connected through the electrical connector 34 in order to control the heating element, 26, and the temperature controller 78 may be electrically connected through the electrical connector 36 in order to control the heating element 28.

Figure 4:
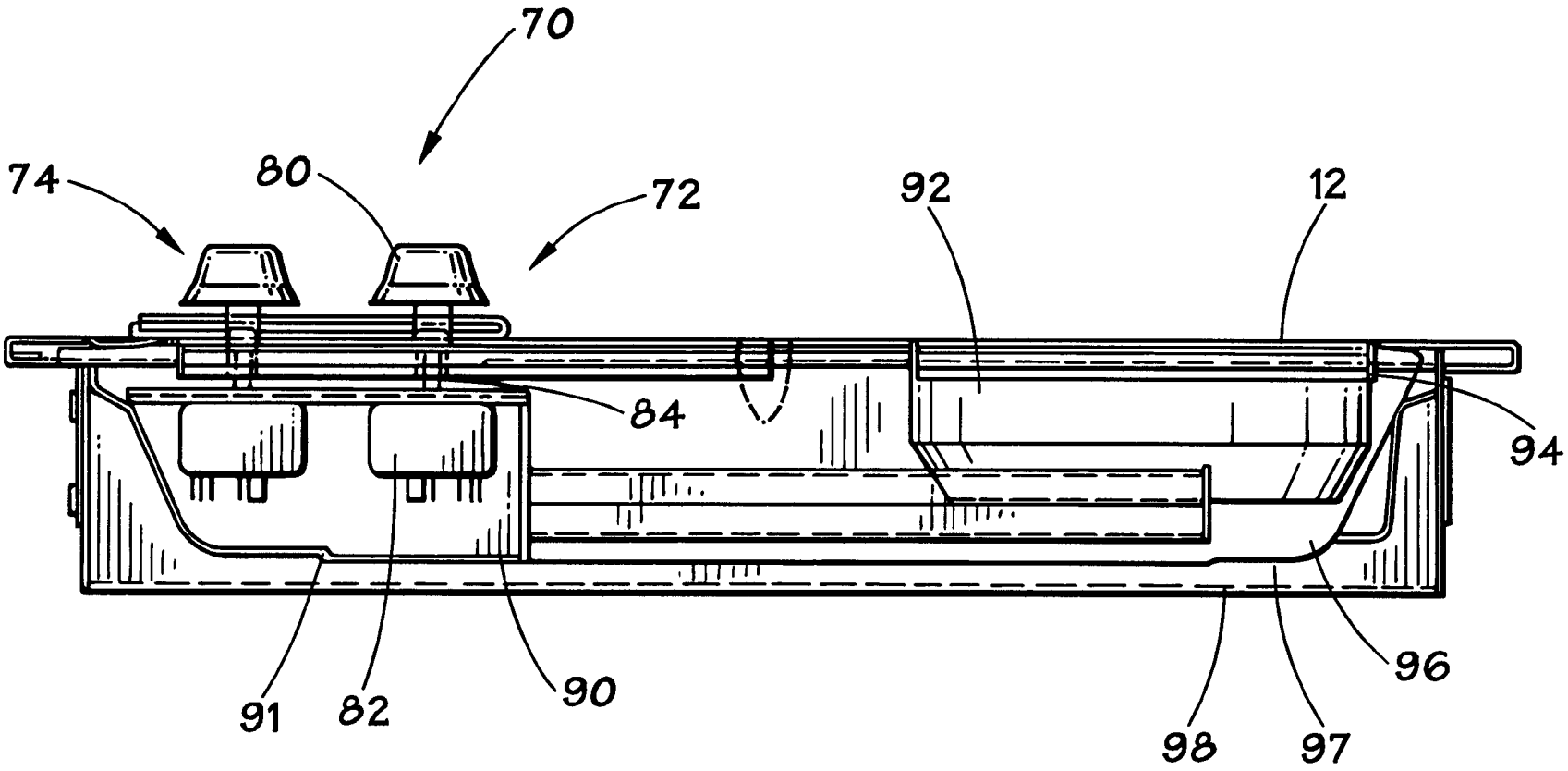
FIG. 4 is a cross sectional view taken along section line 4—4 of FIG. 1; and, FIG. 5 is an exploded view of a representative burner assembly for the cooktop illustrated in FIGS. 1, 2, and 3.

As shown in FIG. 4, the temperature controller 72 has a knob 80 on one side of the wall 12 and a control device 82 on an opposite side of the wall 12. A shaft 84 interconnects the knob 80 and the control device 82 so that a user may turn the knob 80 in order to adjust the control device 82. Adjustment of the control device 82 controls the amount of electricity supplied to the heating element 22 in order to control the amount of heat which it imparts to a cooking vessel resting thereon. The control device 82 may be a potentiometer, a rheostat, a semi-conductor assembly, and/or the like, which is arranged to respond to movement of the shaft 84 in order to control the supply of electricity to the heating element 22. The temperature controllers 74, 76, and 78 may be of similar construction in order to control the amount of electricity supplied to their corresponding heating elements 24, 26, and 28.

The control device 82 of the temperature controller 72, and the control devices of the other temperature controllers 74, 76, and 78, are housed in a control box 90. The control box 90, for example, may be made of galvanized steel and may be provided with foil-backed, glass fiber insulation 91 therearound in order to reduce the amount of heat in the control box 90.

A burner bowl shield 92 is provided in order to reflect heat from the heating element 22. A depending flange 94, which is formed integrally with the wall 12, is provided in order to support the burner bowl shield 92. The burner bowl shield 92 is attached to the depending flange 94 by suitable fasteners, such as sheet metal screws. The depending flange 94 defines the hole through which the basin 42 of the burner bowl 40 protrudes, and the burner bowl shield 92 substantially surrounds the basin 42 of the burner bowl 40. The burner bowl shield 92, for example, may be formed of galvanized steel, and the burner bowl shield 92 may have an opening to permit the electrical connector 30 to mate with its corresponding electrical connector (not shown) supported by the wall 12. Similar burner bowl shields may be provided for the other basins 48, 54, and 60 of the corresponding burner bowls 46, 52, and 58.

The cooktop 10 includes an inner burner box 96 and an outer burner box 98. The wall 12 of the cooktop 10 is suitably arranged to be removably fitted to the inner burner box 96 so that the wall 12, together with the four burner assemblies 14, 16, 18, and 20 that it supports, may be lifted and/or removed in order to permit cleaning of the inner burner box 96. The inner burner box 96 forms a burner box housing with the wall 12 that houses the burner bowl shields of the burner bowls 40, 46, 52, and 58 as well as the control box 90. The inner burner box 96 catches spills and the like that are too abundant to be contained by the burner bowls 40, 46, 52, and 58 or are not otherwise caught by the burner bowls 40, 46, 52, and 58. The inner burner box 96, for example, may be formed of "drawn" galvanized steel.

The outer burner box 98 provides an air space between it and the inner burner box 96 and supports further insulation 97 therearound. This insulation 97 may be foil-backed, glass fiber insulation that protects the counter top in which the cooktop 10 rests from high temperatures. The outer burner box 98 may be formed, for example, of galvanized steel.

A temperature limit 100 is supported within the control box 90 and shuts off the heating element 28 in the event of an over-temperature condition. The temperature limit 100, accordingly, prevents cabinet temperatures in excess of an allowable threshold. The temperature limit 100, for example, may be a temperature sensitive bi-metallic disk limit switch.

Figure 5:
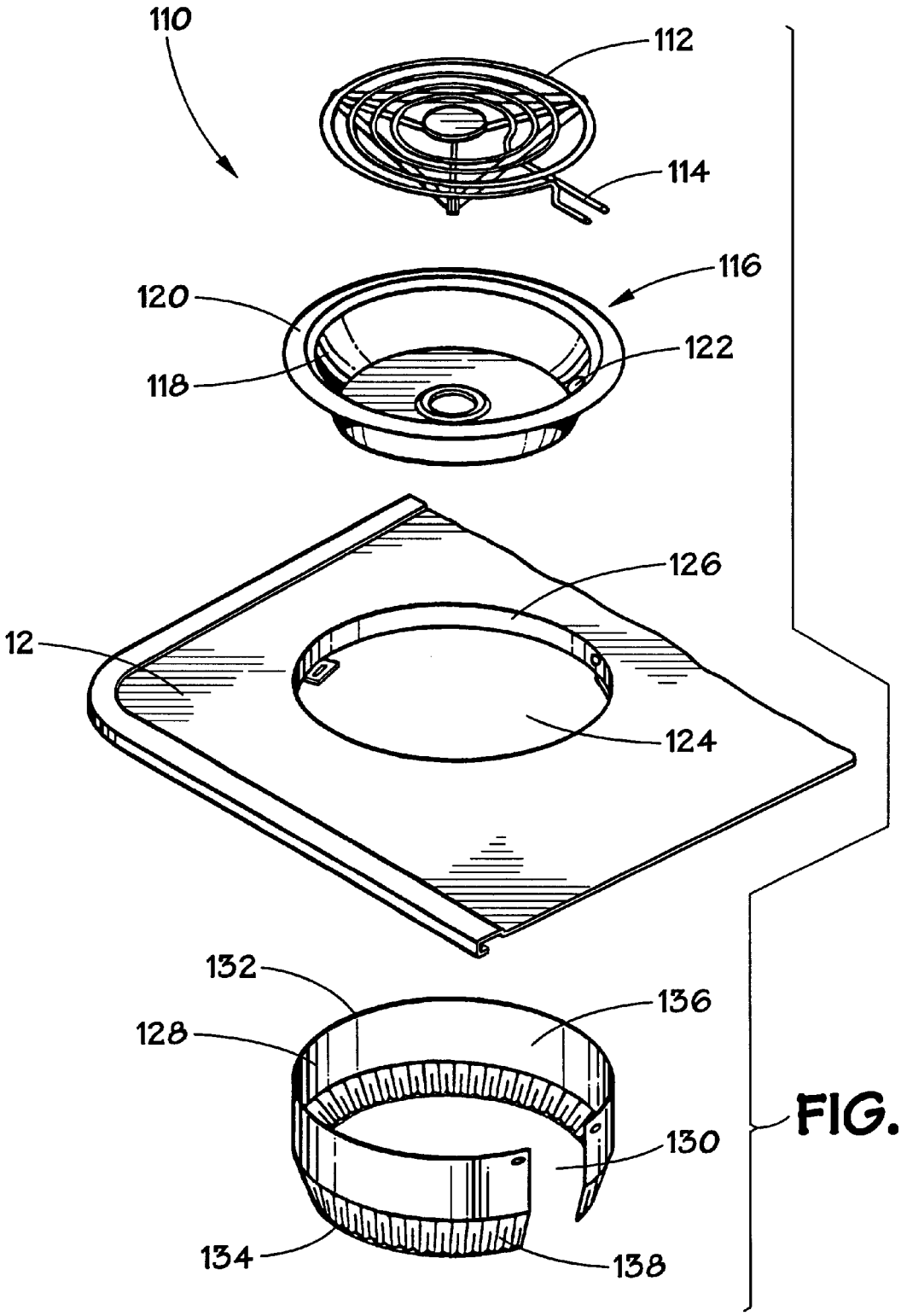

FIG. 5 is an exploded view of a burner assembly 110, which is exemplary of the burner assemblies 14, 16, 18, and 20. The burner assembly 110 includes a heating element 112 which has an electrical connector 114 for connecting the ends of the heating element 112 to a corresponding electrical connector secured to the wall 12 of the cooktop 10. The burner assembly 110 also includes a burner bowl 116 that has a basin 118, which protrudes through a corresponding hole through the wall 12 of the cooktop 10, and a lip 120, which rests against the wall 12 of the cooktop 10 in order to suspend the basin 118 of the burner bowl 116 from the wall 12. Accordingly, the lip 120 resting against the wall 12 supports the basin 118 within its corresponding hole. The burner bowl 116 also has an opening 122 therethrough for receiving the electrical connector 114 of the heating element 112 so that the electrical connector 114 connects the ends of the heating element 112 to a corresponding electrical connector supported by the wall 12 of the cooktop 10.

The basin 118 of the burner bowl 116 protrudes through a corresponding hole 124 through the wall 12 of the cooktop 10. A depending flange 126 of the wall 12 defines the hole 124. A burner bowl shield 128 is suitably attached to the depending flange 126 of the wall 12 so that the burner bowl shield 128 substantially surrounds the basin 118 that protrudes through the hole 124. An opening 130 in the burner bowl shield 128 accommodates the electrical connector 114 in a fashion similar to the opening 122 in the burner bowl 116. The opening 130 may extend entirely from a top edge 132 to a bottom edge 134 of the burner bowl shield 128, or may be formed to extend only partially between the top edge 132 and the bottom edge 134.

The burner bowl shield 128 includes an upper portion 136 and a lower portion 138. Preferably, the burner bowl shield 128 is substantially cylindrical in shape and the lower portion 138 is corrugated, thereby facilitating the dispersion of heat emanating from the heating element 112, and thus, the burner bowl 116. The lower portion 138 is also preferably inclined inwardly toward the center of the cylindrical shaped burner bowl shield 128 with respect to the upper portion 136, further facilitating the dispersion of heat emanating from the heating element 112, and thus, the burner bowl 116.

Certain modifications of the present invention have been discussed above. Other modifications will occur to those practicing in the art of the present invention. For example, as describe above, the temperature limit 100 cuts off only the heating element 22. Alternatively, the temperature limit 100 may be arranged to cut off all of the heating elements 22, 24, 26, and 28, or each of the heating elements 22, 24, 26, and 28 may be provided with its own separate temperature limit, each of which may be similar to the temperature limit 100.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A burner assembly for a cooking appliance comprising:

a heating element;

a porcelain bowl, wherein the porcelain bowl is arranged to receive the heating element; and a bowl shield, wherein the bowl shield substantially surrounds the porcelain bowl, the bowl shield, including upper and lower portions, having a substantially cylindrical shape.

2. The burner assembly of claim 1 wherein the porcelain bowl is a porcelain enameled bowl.

3. The burner assembly of claim 2 further comprising a wall, wherein the wall has a hole therethrough, wherein the porcelain bowl has a basin, and wherein the porcelain bowl is supported by the wall so that the basin protrudes through the hole.

4. The burner assembly of claim 3 wherein the wall is a porcelain enameled wall.

5. The burner assembly of claim 3 wherein the bowl shield is fashioned substantially around the basin so as to reflect heat from the heating element.

6. The burner assembly of claim 3 further comprising a depending flange defining the hole, wherein the bowl shield is fastened to the depending flange.

7. The burner assembly of claim 1 further comprising a wall, wherein the wall has a hole therethrough, wherein the porcelain bowl has a basin, and wherein the porcelain bowl is supported by the wall so that the basin protrudes through the hole.

8. The burner assembly of claim 7 wherein the wall is a porcelain wall.

9. The burner assembly of claim 7 wherein the bowl shield is fashioned substantially around the basin so as to reflect heat from the heating element.

10. The burner assembly of claim 7 further comprising a depending flange defining the hole, wherein the bowl shield is fastened to the depending flange.

11. The burner assembly of claim 1 wherein the bowl shield is fashioned substantially around the porcelain bowl so as to reflect heat from the heating element.

12. A cooktop comprising:

a wall having first and second holes;

a first heating element;

a second heating element;

a first porcelain bowl having a basin protruding through the first hole and having a lip resting on the wall, wherein the basin of the first porcelain bowl is arranged to receive the first heating element;

a second porcelain bowl having a basin protruding through the second hole and having a lip resting on the wall, wherein the basin of the second porcelain bowl is arranged to receive the second heating element;

a first bowl shield, wherein the first bowl shield substantially surrounds the basin of the first porcelain bowl, the first bowl shield, including upper and lower portions, having a substantially cylindrical shape;

a second bowl shield, wherein the second bowl shield is substantially around the basin of the second porcelain bowl, the second bowl shield, including upper and lower portions, having a substantially cylindrical shape;

a first controller for controlling the first heating element; and, a second controller for controlling the second heating element.

13. The cooktop of claim 12 wherein the first porcelain bowl is a porcelain enameled bowl, and wherein the second porcelain bowl is a porcelain enameled bowl.

14. The cooktop of claim 13 wherein the wall has first and second depending flanges respectively defining the first and second holes, wherein the first bowl shield is fastened to the first depending flange, and wherein the second bowl shield is fastened to the second depending flange.

15. The cooktop of claim 14 wherein the wall is a porcelain enameled wall.

16. The cooktop of claim 14 wherein the first bowl shield is fashioned substantially around the first basin so as to reflect heat from the first heating element, and wherein the second bowl shield is fashioned substantially around the second basin so as to reflect heat from the second heating element.

17. The cooktop of claim 12 wherein the wall has first and second depending flanges respectively defining the first and second holes, wherein the first bowl shield is fastened to the first depending flange, and wherein the second bowl shield is fastened to the second depending flange.

18. The cooktop of claim 17 wherein the wall is a porcelain wall.

19. The cooktop of claim 17 wherein the first bowl shield is fashioned substantially around the first basin so as to reflect heat from the first heating element, and wherein the second bowl shield is fashioned substantially around the second basin so as to reflect heat from the second heating element.

20. The cooktop of claim 12 wherein the first bowl shield is fashioned substantially around the first porcelain bowl so as to reflect heat from the first heating element, and wherein the second bowl shield is fashioned substantially around the second porcelain bowl so as to reflect heat from the second heating element.

21. The cooktop of claim 12 further comprising a temperature limit arranged to deactivate the first controller in the event of an over temperature condition.

22. A cooktop comprising:

a burner box;

a wall arranged to be removably fitted to the burner box so as to form a burner box housing, wherein the wall has a plurality of holes therethrough;

a plurality of heating elements;

a plurality of porcelain bowls, wherein each of the porcelain bowls has a corresponding basin, wherein each of the porcelain bowls is arranged to receive a corresponding heating element, and wherein the basin of each of the porcelain bowls protrudes through a corresponding hole into the burner box housing;

a plurality of bowl shields, wherein each of the bowl shields is fashioned substantially around the basin of a corresponding porcelain bowl, each of the bowl shields, including upper and lower portions, each bowl shield having a substantially cylindrical shape;

a control box in the burner box housing, wherein in the control box is fashioned substantially around a portion of the controls protruding through the wall.

23. The cooktop of claim 22 wherein the wall has a plurality of depending flanges, wherein each of the depending flanges defines a corresponding one of the plurality of holes, and wherein each of the plurality of bowl shields is fastened to a corresponding one of the plurality of depending flanges.

24. The cooktop of claim 23 wherein each of the porcelain bowls has a lip which rests against the wall as the basin of a corresponding porcelain bowl protrudes through a corresponding hole in the wall, and wherein each of the bowl shields is secured to the wall at a corresponding hole.

25. The cooktop of claim 24 further comprising a first insulation cooperating with the control box in order to reduce heat in the control box, and a second insulation cooperating with the burner box in order to reduce heat outside of the burner box.

26. The cooktop of claim 23 wherein each of the bowl shields is fashioned substantially around a corresponding basin so as to reflect heat from a corresponding heating element.

27. The cooktop of claim 23 further comprising a temperature limit arranged to deactivate at least one of the plurality of controls in the event of an over temperature condition.

28. The cooktop of claim 22 wherein each of the porcelain bowls has a lip which rests against the wall as the basin of a corresponding porcelain bowl protrudes through a corresponding hole in the wall, and wherein each of the bowl shields is secured to the wall at a corresponding hole.

29. The cooktop of claim 22 wherein the wall is a porcelain wall.

30. The cooktop of claim 29 further comprising a temperature limit arranged to deactivate at least one of the plurality of controls in the event of an over temperature condition.

31. The cooktop of claim 30 further comprising a first insulation cooperating with the control box in order to reduce heat in the control box, and a second insulation cooperating with the burner box in order to reduce heat outside of the burner box.

32. The cooktop of claim 22 further comprising a temperature limit arranged to deactivate at least one of the plurality of controls in the event of an over temperature condition.

33. The cooktop of claim 32 further comprising a first insulation cooperating with the control box in order to reduce heat in the control box, and a second insulation cooperating with the burner box in order to reduce heat outside of the burner box.

34. The cooktop of claim 33 wherein each of the porcelain bowls has a lip which rests against the wall as the basin of each of the porcelain bowls projects through a corresponding hole in the wall, and wherein each of the bowl shields is secured to the wall at a corresponding hole.

35. The cooktop of claim 22 further comprising a first insulation cooperating with the control box in order to reduce heat in the control box, and a second insulation cooperating with the burner box in order to reduce heat outside of the burner box.

36. The cooktop of claim 35 wherein each of the porcelain bowls has a lip which rests against the wall as the basin of each of the porcelain bowls projects through a corresponding hole in the wall, and wherein each of the bowl shields is secured to the wall at a corresponding hole.

* * * * *